US008205972B2

(12) United States Patent
Hara

(10) Patent No.: US 8,205,972 B2
(45) Date of Patent: Jun. 26, 2012

(54) IMAGE FORMING APPARATUS

(75) Inventor: Koichiro Hara, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 1118 days.

(21) Appl. No.: 12/080,615

(22) Filed: Apr. 4, 2008

(65) Prior Publication Data

US 2008/0246822 A1 Oct. 9, 2008

(30) Foreign Application Priority Data

Apr. 4, 2007 (JP) ..... 2007-098599

(51) Int. Cl.
*B41J 2/17* (2006.01)

(52) U.S. Cl. ..... 347/84; 347/22; 347/23; 347/27; 347/28; 347/29; 347/30; 347/31; 347/32; 347/35; 347/36

(58) Field of Classification Search ..... 347/22–23, 347/27–32, 35–36, 90, 92, 84
See application file for complete search history.

(56) References Cited

U.S. PATENT DOCUMENTS

| | | | | |
|---|---|---|---|---|
| 7,150,513 | B2 * | 12/2006 | Shinkawa et al. | 347/23 |
| 7,513,592 | B2 * | 4/2009 | Miyazawa | 347/29 |
| 7,918,531 | B2 * | 4/2011 | Sugiyama et al. | 347/23 |
| 2002/0054183 | A1 * | 5/2002 | Kanaya | 347/23 |
| 2004/0113973 | A1 * | 6/2004 | Nakashima | 347/35 |
| 2005/0078144 | A1 * | 4/2005 | Yamada et al. | 347/30 |
| 2005/0093919 | A1 * | 5/2005 | Takatsuka et al. | 347/30 |
| 2005/0122372 | A1 * | 6/2005 | Shimizu | 347/22 |
| 2006/0209119 | A1 * | 9/2006 | Yonekubo et al. | 347/27 |
| 2006/0214981 | A1 * | 9/2006 | Fukasawa et al. | 347/29 |
| 2006/0268054 | A1 * | 11/2006 | Sugahara | 347/35 |
| 2006/0274108 | A1 * | 12/2006 | Shimizu | 347/22 |
| 2007/0046721 | A1 * | 3/2007 | Miyazawa | 347/29 |
| 2007/0146417 | A1 * | 6/2007 | Jung et al. | 347/36 |
| 2007/0236535 | A1 * | 10/2007 | Baker et al. | 347/36 |
| 2008/0238983 | A1 * | 10/2008 | Takahashi | 347/23 |

FOREIGN PATENT DOCUMENTS

JP 2006 192862 7/2006

* cited by examiner

*Primary Examiner* — Ryan Lepisto
*Assistant Examiner* — Guy Anderson
(74) *Attorney, Agent, or Firm* — Frommer Lawrence & Haug LLP

(57) ABSTRACT

An image forming apparatus includes a recording head having a nozzle surface in which a plurality of nozzles is formed; and a vibration generating mechanism which is arranged at a position away from a recording medium in a moving direction of a recording head, and which intermittently sucks or blows air from and to the nozzle surface of the recording head moved to the position. The vibration generating mechanism vibrates a meniscus of a liquid inside each of the nozzles. Accordingly, there is provided an image forming apparatus in which the liquid is not consumed unnecessarily and thus is economical, and which effectively facilitates maintenance and recovery of the jetting function of the nozzles.

25 Claims, 5 Drawing Sheets

IMAGE FORMING APPARATUS

CROSS REFERENCE TO RELATED APPLICATION

The present application claims priority from Japanese Patent Application No. 2007-098599, filed on Apr. 4, 2007, the disclosure of which is incorporated herein by reference in its entirety.

BACKGROUND OF THE INVENTION

1. Field of the Invention

The present invention relates to an image forming apparatus which jets a liquid droplet onto a recording medium (medium) and records a character and/or a diagram (image) on a surface of the recording medium.

2. Description of the Related Art

An image forming apparatus which records an image (a character and/or a diagram) by jetting a droplet of a liquid (liquid droplet) includes, as in an ink-jet printer, etc., a carriage which reciprocates in a direction of width of a recording medium, and a recording head provided on the carriage and having a plurality of nozzles through which the ink droplets are jetted. Further, during the time when the carriage reciprocates with respect to the recording medium, ink droplets are jetted toward the recording medium from the nozzles in the recording head. Accordingly, an image is formed by ink dots on a surface of the recording medium.

In such an image forming apparatus, a means for realizing a high-speed recording and a high image quality can be exemplified by achieving high image quality by making ink droplets jetted to be minute, and achieving the high-speed recording by increasing a moving (reciprocating) speed of the carriage. However, when an attempt is made to make the ink droplets minute or fine, the diameter of the nozzle becomes small, and by a thickening effect due to the drying of ink inside the nozzles, jetting characteristics are easily to decline at an early stage. On the other hand, when the traveling speed of the carriage is increased, evaporation of a moisture content in the ink advances and thus making the ink dry easily, thereby resulting in thickening of the ink and declining the image quality.

Therefore, as a process for performing the maintenance and recovery of the jetting function by reducing thickening of the ink inside the nozzle, flushing process is carried out. The flushing process includes, for example, a so-called waste jetting (waste discharge) in which thickened ink inside the nozzle is discharged by jetting the ink from the nozzle irrespective of recording (for example, see pages 6 and 7, and FIG. 3 of Japanese Patent Application Laid-open No. 2006-192862).

SUMMARY OF THE INVENTION

However, since the above-described flushing process consumes a large amount of the ink unnecessarily, the flushing process can be hardly called as an effective process of maintenance and recovery of the jetting function of nozzles.

Therefore, an object of the present invention is to provide an image forming apparatus which is capable of realizing an effective maintenance and recovery of the jetting function of nozzles, without consuming a liquid unnecessarily, and thus is economical.

According to an aspect of the present invention, there is provided an image forming apparatus which forms an image by jetting a liquid onto a medium, including:

a recording head having a nozzle surface in which a plurality of nozzles is formed; and a vibration generating mechanism which is arranged to face the nozzle surface of the recording head, and which vibrates a meniscus of the liquid inside each of the nozzles by sucking air between the nozzle surface and the vibration generating mechanism or by blowing air to the nozzle surface.

In this case, the vibration generating mechanism is capable of vibrating the meniscus of the liquid inside the nozzle, by sucking or blowing the air. By doing so, the liquid inside the nozzle is stirred or agitated, thereby lowering the increase in viscosity (thickening) of the liquid. Consequently, it is possible to realize the maintenance and recovery of the jetting function of the nozzle. In other words, it is possible to effectively carry out the maintenance and recovery processes of the jetting function of the nozzle without consuming the liquid.

The image forming apparatus of the present invention may further include a moving mechanism which moves the recording head in a predetermined direction relative to the medium; wherein the vibration generating mechanism may be arranged at a position away from the medium in the predetermined direction. In this case, the vibration generating mechanism is positioned at a position away from the medium in the predetermined direction. Therefore, in a case that the recording head is moved up to the position facing the vibration generating mechanism and the meniscus of the liquid inside the nozzle of the recording head is vibrated, there is no possibility that the liquid might make contact with the medium even if the liquid is leaked from the nozzle.

In the image forming apparatus of the present invention, the vibration generating mechanism may have a plurality of vibration generating sections provided in the predetermined direction; and the vibration generating sections may be used selectively according to a width of the medium.

In this case, it is possible to use a vibration generating section, among the plurality of vibration generating sections, which corresponds to the width of the medium. For example, when the width of the medium is narrow, it is possible to use a vibration generating section, among the plurality of vibration generating section, located near to the medium. Therefore, it is possible to shorten a moving (traveling) distance of the recording head. In other words, for the purpose of maintenance and recovery operation of the meniscus, the recording head moves from the position facing the medium to the position facing the vibration generating section; and it is possible to shorten the moving distance and to improve the throughput of the recording operation.

The image forming apparatus of the present invention may further include a setting unit which sets the width of the recording medium; wherein when the recording head is moved to a position away from an are corresponding to the set width, a vibration generating section among the plurality of vibration generating section which is arranged in the vicinity of the recording medium may be used.

In this case, it is possible to carry out the maintenance and recovery operation of the recording head by using the vibration generating section located near to the recording medium based on a size, of the width of the recording medium, which is set by the setting unit. As a result, it is possible to shorten the moving distance of the recording head from the position at which the recording head faces the medium and the position at which the recording head faces the vibration generating section for the maintenance and recovery operation of the recording head, and it is possible to improve the throughput of the recording operation.

The image forming apparatus of the present invention may further include a detecting mechanism which detects the width of the medium; wherein the setting unit may set the width of the medium by the detecting mechanism.

In this case, it is possible to detect the size of the medium by the detecting mechanism, and the setting unit is capable of setting the width size based on the detection result. Therefore, similarly as mentioned above, it is possible to carry out the maintenance and recovery operation of the recording head by using the vibration generating section near the recording medium. Therefore, since it is possible to set an appropriate width size, and to shorten the moving distance of the recording head, thereby improving the throughput of the recording operation.

In the image forming apparatus of the present invention, the vibration generating mechanism may suck or blow the air continuously while moving relative to the recording head, and may successively vibrate the meniscus of the liquid inside each of the nozzles facing the vibration generating mechanism.

In this case, since the meniscus of the liquid inside the nozzles is successively made to vibrate by the vibration generating section which moves relative to the recording head, it is possible to maintain and recover the jetting function of the nozzle without consuming the liquid. Further, since it is possible to make a length in the moving direction of the recording head, of the vibration generating section, to be shorter than a length of the nozzle surface of the recording head, the image forming apparatus can be made compact. Moreover, in the image forming apparatus of the present invention, it is possible to efficiently carry out the maintenance and recovery process of the jetting function of the nozzle without consuming the liquid.

In the image forming apparatus of the present invention, the vibration generating mechanism may be a mechanism which sucks the air; and in a state that the vibration generating mechanism face the nozzles, the recording head may apply a pressure, to the liquid inside each of the nozzles, to an extent that the meniscus is not destroyed.

In this case, since the application of the pressure by the head and the suction of the air by the vibration generating mechanism are carried out simultaneously, it is possible to effectively vibrate the liquid inside the nozzle and to carry out highly effective maintenance and recovery process of the jetting function of the nozzle.

In the image forming apparatus of the present invention, the vibration generating mechanism may suck the air; and in a state that the vibration generating mechanism faces the nozzles, the recording head may jet a small amount of the liquid inside the nozzles; and the vibration generating mechanism may suck the small amount of the liquid jetted from the nozzles.

In this case, upon sucking the air by the vibration generating mechanism, a small or minute amount of the liquid inside the nozzle (such as in a fine mist form) is jetted, thereby making it possible to effectively maintain and recover the function of the nozzle. Further, since the minute amount of the jetted liquid is sucked and recovered by the vibration generating section, it is possible to prevent the liquid from adhering to the medium, etc. In other words, the image forming apparatus of the present invention is capable of vibrating the liquid inside the nozzle more effectively. Besides, since a small amount of the liquid which has been jetted is recovered by the vibration generating section, it is possible to carry out highly effective maintenance and recovery process of the jetting function of the nozzle, without causing any stain, etc. by the liquid.

In the image forming apparatus of the present invention, the vibration generating mechanism may blow the air; and the blown air may have humidity higher than that of atmosphere. Further, the vibration generating mechanism may blow the air; and the vibration generating mechanism may have a humidifying mechanism which increase the humidity of the air inside the vibration generating mechanism.

In this case, it is possible to make the humidity of the air higher than at least that of the atmosphere, and to suppress drying of the liquid inside the nozzle as much as possible.

In the image forming apparatus of the present invention, the vibration generating mechanism may face the nozzle surface of the recording head moved to the position, and may alternately suck and blow the air, and may vibrate the meniscus of the liquid inside each of the nozzles.

In this case, the vibration generating mechanism is capable of alternately sucking and blowing the air, thereby making it possible to vibrate the meniscus of the liquid inside the nozzles. Therefore, it is possible to realize the maintenance and recovery of the jetting function of the nozzle without consuming the liquid. Consequently, it is possible to effectively carry out the maintenance and recovery process of the jetting function of the nozzle, without consuming the liquid.

In the image forming apparatus of the present invention, in a state that the vibration generating mechanism sucks the air, the recording head may apply a pressure to the liquid inside each of the nozzles to an extent that the meniscus is not destroyed.

In this case, since the suction of air by the vibration generating mechanism and the application of the pressure by the recording head are carried out simultaneously, it is possible to vibrate the liquid inside the nozzles more effectively. Therefore, it is possible to carry out the highly effective maintenance and recovery process of the jetting function of the nozzle.

In the image forming apparatus of the present invention, in a state that the vibration generating mechanism sucks the air, the recording head may jet a small amount of the liquid inside the nozzles; and the vibration generating mechanism may suck the small amount of the liquid jetted from the nozzles.

In this case, upon sucking the air by the vibration generating mechanism, a small amount of the liquid inside the nozzle is jetted (such as in a fine mist form), thereby making it is possible to maintain and recover the function of the nozzle effectively. Further, since the small amount of jetted liquid is sucked and recovered by the vibration generating mechanism, it is possible to prevent the liquid from adhering to the medium. In other words, the image forming apparatus of the present invention is capable of vibrating the liquid inside the nozzles more effectively. In addition, since the small amount of the jetted liquid is recovered by the vibration generating section, it is possible to carry out highly effective maintenance and recovery process of the jetting function of the nozzle, without causing any stain, etc. by the liquid.

In the image forming apparatus of the present invention, the blown air may have humidity higher than that of the atmosphere.

In this case, by making the humidity of the air to be higher than at least that of the atmosphere, it is possible to suppress the drying of the liquid inside the nozzles as much as possible. With this, it is possible to improve the effect of the maintenance and recovery of the jetting function of the nozzle.

The image forming apparatus of the present invention may further include a platen which supports the medium at a position facing the recording head; wherein the vibration generating mechanism may be arranged to extend from the platen in a moving direction of the recording head; an opening through which the air circulates may be formed at a portion, of the vibration generating mechanism, away from the medium; and the vibration generating mechanism may include a pump which circulates the air through the opening.

In this case, by sucking the air from or blowing the air to the nozzle surface by the pump from the opening provided in an extended portion of the platen supporting the recording medium, it is possible to vibrate the meniscus of the liquid inside the nozzles. Further, since the opening is provided in the extended portion of the platen, it is possible to simplify the structure of the vibration generating section without providing an obstacle to the movement of the recording head.

The image forming apparatus of the present invention may further include a platen which supports the medium at a position facing the recording head; wherein the vibration generating mechanism may be arranged to extend from the platen in a moving direction of the recording head; an opening through which the air circulates may be formed at a portion, of the vibration generating mechanism, away from the medium; the vibration generating mechanism may include a pump which circulates the air through the opening; an opening may be formed in a surface, of the platen, on a side of the medium; and the pump may suck the air from both of the opening of the vibration generating mechanism and the opening of the platen.

In this case, by sucking the air by the pump, it is possible to attract the recording medium to the platen by suction, and to improve the recording quality by improving the flatness of the medium. Further, it is also possible to vibrate the meniscus of the liquid inside the nozzles. Moreover, since the opening is provided in the extended portion of the platen, it is possible to simplify the structure of the vibration generating section without creating any obstacle to the movement of the recording head. Therefore, it is possible to achieve both the improvement in the recording quality by improving the flatness of the recording medium, and the effect of the maintenance and recovery of the jetting function of the nozzle.

In the image forming apparatus of the present invention, the opening of the vibration generating mechanism and the opening the platen may be provided as a plurality of openings on one plane in the moving direction of the recording head; and the openings may be used, based on the width of the medium, selectively and appropriately as openings of the vibration generating mechanism and openings for suction-attracting the recording medium with respect to the platen.

In this case, since a plurality of openings is provided on one plane, it is possible to attract media of various widths to the platen by the suction, and to carry out the maintenance and recovery process of the recording head by using an opening, among the openings, near the medium. Therefore, it is possible to shorten the moving distance of the recording head, and to improve the throughput of the recording operation. In other words, it is possible to improve the recording quality by improving the flatness of the media of various widths, and it is also possible to achieve the maintenance and recovery of the jetting function by a movement of the recording head over a short distance, and to improve the throughput of the recording operation.

The image forming apparatus of the present invention may further include a platen which supports the medium at a position facing the recording head; wherein the vibration generating mechanism may be formed integrally with the platen. In this case, the number of parts can be reduced by forming the platen and the vibration generating mechanism integrally.

DETAILED DESCRIPTION OF THE PREFERRED EMBODIMENTS

Figure 1:
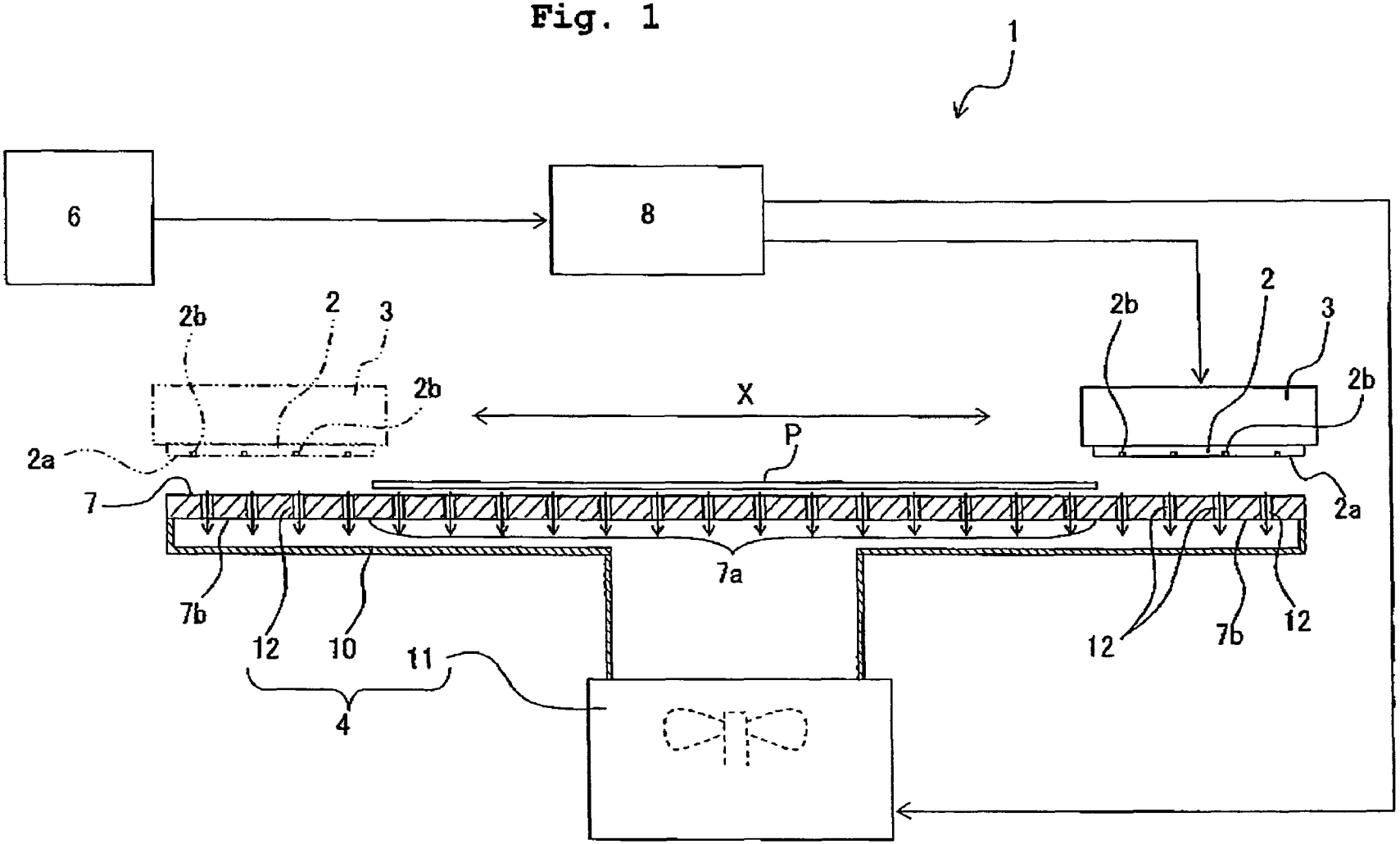
FIG. 1 is a schematic diagram showing an embodiment of an image forming apparatus according to the present invention.

Embodiments of an image forming apparatus according to the present invention will be described below with reference to the accompanying diagrams. FIG. 1 shows an image forming apparatus 1 as seen from a transporting direction of a recording medium.

As shown in FIG. 1, the image forming apparatus 1 mainly includes a recording head 2, a carriage 3 reciprocating in an X direction in FIG. 1 on which the recording head 2 is mounted, a vibration generating section 4 which will be described later, a setting section 6 which sets a size of a recording paper P, a long member 7 which is elongated in the X direction, and a control section 8 which controls a drive of the carriage 3. The carriage 3 is reciprocatable in a width direction of the recording paper P (main scanning direction) indicated by an arrow X by a known scanning unit (moving unit). The recording paper P is supported from a lower side by a platen 7*a* which includes the long member 7, and is transported by a known transporting unit in a direction orthogonal to a paper surface in FIG. 1 (secondary scanning direction).

The recording head 2 is mounted on a side of the carriage 3, facing the recording paper P. In a surface (nozzle surface 2*a*) of the recording head 2, facing the recording paper P, a plurality of nozzle rows arranged at a predetermined interval (distance) in the main scanning direction is formed. Each of the nozzle rows includes a plurality of nozzles 2*b* aligned in the secondary scanning direction. In the embodiment, each of the nozzle rows corresponds to a color of ink which is jetted.

A length of the long member 7 in the main scanning direction X is not less than a length obtained by adding to a maximum recordable width of the recording paper, and twice the length of the recording head 2 in the main scanning direction X. Moreover, a width of the long member 7 in a direction orthogonal to the paper surface (secondary scanning direction) is not less than a length in the secondary scanning direction of each row of the nozzles 2*b* of the recording head 2. A portion of the long member 7, in a central part in a longitudinal direction, corresponding to the width of the recording paper P corresponds to a platen 7*a*, and an extended portion 7*b* on both sides thereof forms a part of the vibration generating section 4 which will be described later.

A plurality of openings (apertures) 12 are formed in the long member 7 almost throughout the entire length and the entire width of the long member 7. Each opening 12 is formed by a through hole 12*a* which is pierced from an upper surface of the long member 7 (surface facing the recording head 2 and the recording paper P) up to a lower surface thereof. The long member 7 is connected to a pump 11 via a duct 10 which is arranged to cover the lower surface thereof. It is possible to use various types of known propellers, and a rotating piston as the pump 11. By driving the pump 11, it is possible to suck air from an upper-surface side of the long member 7 via each through hole 12*a*.

It is possible to bring the recording paper P close to the long member 7 by sucking air from openings 12 formed in the long member 7, in an area (platen 7*a*) corresponding to the width of the recording paper P. Accordingly, it is possible to improve the recording quality by improving the flatness of the recording paper P.

Figure 5:
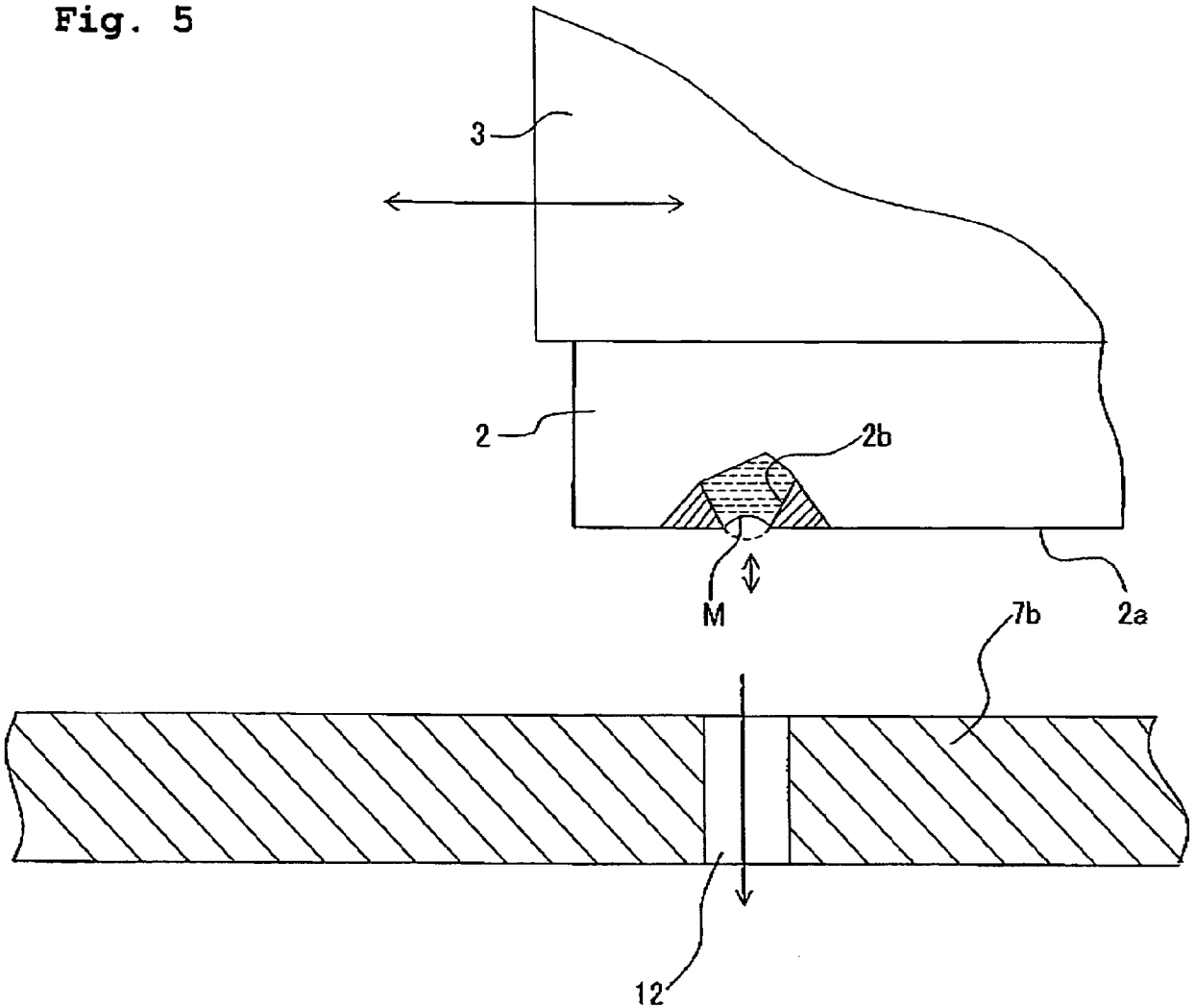
FIG. 5 is a schematic diagram showing the forth embodiment.

When the recording head 2 is positioned to face an area (extended portion 7*b*) of the long member 7, on an outer side of the width of the recording paper 2, it is possible to make a space between the nozzle surface 2*a* and the extended portion 7*b* to have a negative pressure by sucking air from the opening 12 formed in the extended portion 7*b*. As shown in FIG. 5, a meniscus M of the ink inside the nozzle 2*b* is pulled downward by this negative pressure as shown in FIG. 5. Moreover, when the negative pressure is weakened, the meniscus M becomes concave toward an inner side of the nozzle due to a known back pressure which operates originally on the ink. In this manner, it is possible to make vibrate the meniscus M by making the back pressure strong and weak. It is possible to realize applying or releasing pressure to and from the meniscus M, by making the negative pressure strong or weak, by driving the pump 11 intermittently, or by relatively moving the nozzle 2*b* and the opening 12 by moving the carriage 3. The ink inside the nozzle is agitated by making the meniscus M vibrate for the appropriate number of times, and it is possible to prevent drying of the ink which is in contact with air.

A suction force of the pump 11 and a diameter of the opening (aperture) 12 is determined appropriately according to factors such as the number of nozzles 2*b*, an aperture diameter (hole diameter) of nozzles 2*b*, a viscosity of the ink, physical properties such as a surface tension, and a distance between the nozzle surface 2*a* and the extended portion 7*b* (approximately 2 mm in this embodiment). The suction force may be adjusted according to an environmental temperature.

The extended portion 7*b*, the opening (aperture) 12, the duct 10, and the pump 11 form a vibration generating mechanism 4 which makes the meniscus M vibrate. In this embodiment, the pump 11 is provided in common to all the openings (apertures) 12. However, the pump 11 may be provided corresponding to each opening 12, or it is also possible to provide the pump 11 for each opening (aperture) 12 or for each group, letting a plurality of openings 12 to be one group. In other words, it also possible to consider that, each opening 12 forms one vibration generating mechanism 4. Moreover, when the width of the recording paper P changes, the number of openings (apertures) 12 positioned away from the width (the number of openings 12 not facing the recording paper P) is changed. And among the plurality of vibration generating mechanisms 4, the vibration generating mechanism 4 facing the nozzle surface 2*a* is selectively used for making the meniscus M vibrate.

The reciprocating movement of the carriage 3 is controlled by a control unit 8. At the time of carrying out recording on the recording paper P, the control unit 8 controls the carriage 3 to reciprocate in a range of the side of the width of the recording paper P based on a size setting of the width of the recording paper P carried out in a setting unit 6. Moreover, at the time of carrying out a process of maintaining and recovering a jetting function of the nozzles 2*b*, the control unit 8 controls the carriage 3 such that the carriage 3 is moved to a position away from the recording paper P by an amount of length in the main scanning direction of the nozzle surface 2*a* of the recording head 2. In this embodiment, the setting unit 6 selects the size of the recording paper by a key operation from an operation panel provided to the image forming apparatus 1, or sets the size of the width of the recording paper upon receiving size data of the recording paper P which is set together with a document data by a personal computer connected to the image forming apparatus 1.

In a case of carrying out recording on the recording paper P by the image forming apparatus 1, when the recording paper P is supplied, the control unit B drives the pump 11 to suck the air from each opening (aperture) 12. Moreover, the control unit 8 controls the carriage 3 to reciprocate in a range of the width, based on the width size which is set in the setting unit 6, and controls to jet the ink on to the recording paper P from the nozzles 2*b* of the recording head 2. In this manner, an image is formed by ink dots on the surface of the recording paper P.

For the reciprocating movement every time or for the number of times, the control unit 8 moves the carriage 3 outside the recording paper P, such that the nozzle surface 2*a* of the recording head 2, and the opening (aperture) 12 of the vibration generating portion 4 face mutually. At this time, the carriage 3 may be positioned at a position outside the recording paper P of the maximum width, and it is preferable that an end of the nozzle surface 2*a* is positioned to face the opening 12 nearest to an end of the recording paper or another opening 12 away from the nearest opening 12 by an amount of an appropriate number of openings 12, based on the width size setting. Moreover, the control unit 8 drives the pump 11 intermittently with the carriage 3 stopped, and makes the meniscus of the ink inside the nozzles 2*b* vibrate. At this time, a central axis of the nozzle 2*b* and the opening 12 may not coincide mutually.

In this embodiment, the image forming apparatus 1 enables the process of maintenance and recovery of the jetting function of the nozzles 2*b*, on both sides of the recording paper P. However, it is also possible to make an arrangement such that the similar process is carried out on only one side of the recording paper P.

Figure 2:
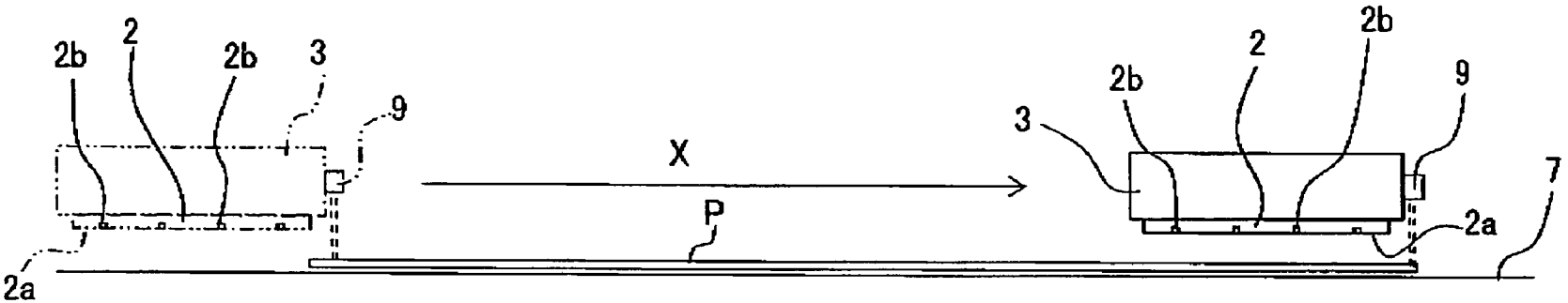
FIG. 2 is a schematic diagram which explains a detecting mechanism for setting a width of a recording paper in a setting unit 6 in the embodiment.

The setting unit 6 is capable of setting the width size by using a detecting mechanism (sensor) which detects the width size of the recording paper P. FIG. 2 shows an example of the detecting mechanism. The carriage 3 may include a sensor 9 facing the recording paper P. The detecting mechanism moves the carriage 3 in the direction of width of the recording paper P, and detects the width size of the recording paper P based on a detection signal from the sensor 9 and an amount of movement of the carriage 3, and the setting unit 6 sets this detection result as the width size of the recording paper P.

Figure 3:
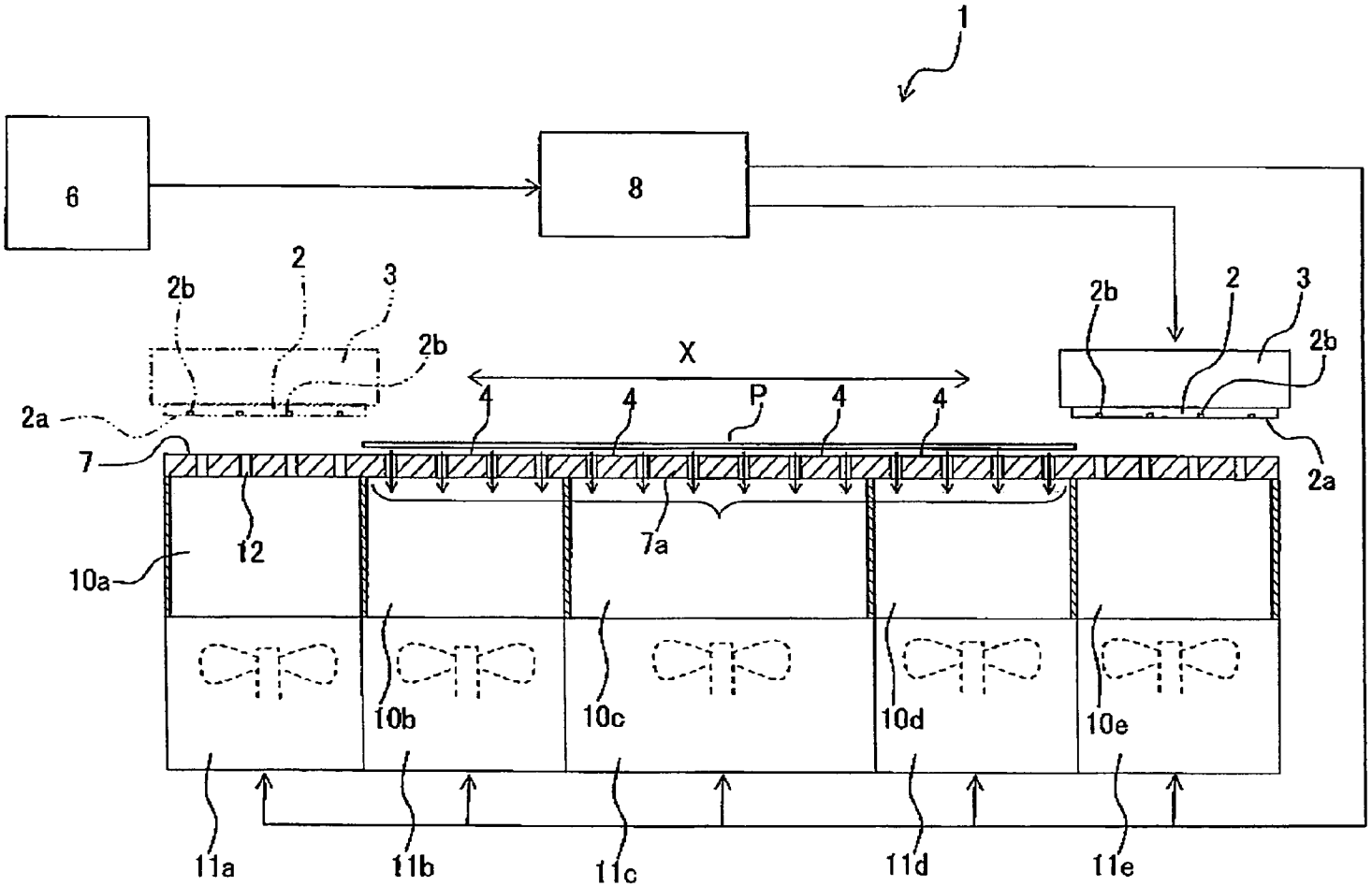
FIG. 3 is a schematic diagram showing the second embodiment.

FIG. 3 shows a second embodiment. In the second embodiment, a plurality of openings (apertures) 12 formed throughout almost the entire length of the long member 7 is divided into a plurality of groups in a direction of movement of the carriage 3. Each group is connected to one of independent pumps 11*a* to 11*e* via ducts 10*a* to 10*e*. The control unit 8 drives selectively each of the pump 11*a* to 11*e* based on the width size of the recording paper P.

In other words, the control unit 8 carries out a suction drive of the pump (11*b* to 11*d* in FIG. 3) connected to the groups of the openings (apertures) 12 corresponding to the width of the recording paper P, and brings the recording paper P close to the platen 7*a*, and carries out a recording operation. Moreover, the control unit 8, for maintenance and recovery of the jetting function of the nozzles 2*b*, makes the meniscus of the nozzles 2*b* vibrate by carrying out the suction drive of the pump (the pump 11*e* in FIG. 3) connected to a group of the openings (apertures) 12 facing the nozzle surface 2*a*, when the carriage 3 is moved outside the width of the recording paper P. When the process of maintenance and recovery of the jetting function of the nozzles 2*b* is not carried out, it is possible to carry out a control such that the pump outside the width of the recording paper is not driven.

In the abovementioned structure, when the width of the recording paper P is small, and for example, only the pumps 11*b* and 11*c* are (to be) used for holding the recording paper P, it is possible to use the adjacent pump 11*d* for the maintenance and recovery of the jetting function of the nozzles 2*b*.

In a case of the structure in FIG. 3, it is possible to make an arrangement such that the pump (the pump 11*e* in FIG. 3) connected to the group of the openings (apertures) 12 facing the nozzle surface 2*a* carries out blowing but not suction. In other words, by causing the air blown from the opening (aperture) 12 to be applied continuously to the meniscus inside the nozzle 2*b*, the meniscus is made to vibrate, and the jetting function of the nozzles 2*b* is maintained and recovered. When the width of the recording paper P is large (wide), the recording paper P is sucked by carrying out the suction drive of the pump 11*d* for example, but when the width of the recording paper P is small, air is made to be blown from the opening (aperture) 12 by carrying out a reverse drive of the pump 11*d*, and is made to be applied to the meniscus inside the nozzle 2*b*.

Figure 4:
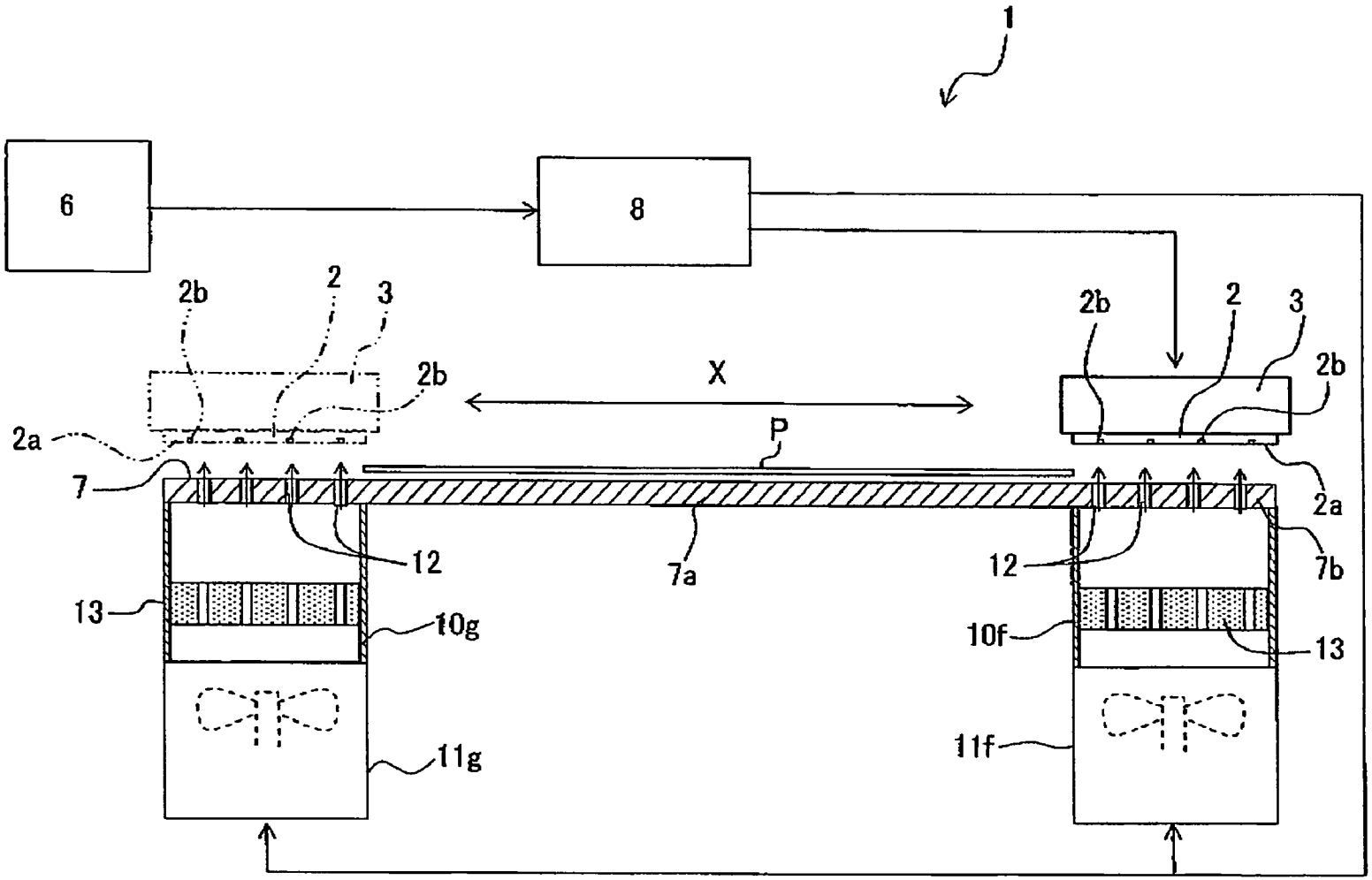
FIG. 4 is a schematic diagrams showing the third embodiment.

FIG. 4 shows a third embodiment. In the third embodiment, the plurality of openings (apertures) 12 is provided near both ends in a longitudinal direction of the long member 7, and an opening (aperture) is not provided at a position corresponding to the recording paper P. Pump 11*f* and 11*g* are connected to each group of openings (apertures) 12 at both ends, via ducts 10*f* and 10*g*. The control unit 8 controls the carriage 3 to reciprocate based on the width size of the recording paper P to perform printing. Moreover, the control unit 8, for the maintenance and recovery of the jetting function of the nozzles 2*b*, moves the carriage 3, and makes the nozzle surface 2*a* face one group of the openings 12. In this state, the meniscus of the nozzle 2*b* is made to vibrate by driving the pump (the pump 11*f* in FIG. 4) connected to that group.

In this structure, the pump carries out any of suction and blowing of air. When the pump carry out blowing the air, the air to be blown to the meniscus may have a humidity higher than (the humidity of) the atmosphere by a humidifying unit (humidor, humidifying mechanism) 13 in the ducts 10*f* and 10*g*. Accordingly, it is possible to suppress as much as possible, the drying of the ink inside the nozzles 2*b*. As the humidifying unit 13, it is possible to use a unit which mixes moisture in a porous material, and humidifies air which passes through the porous material, or a unit which sprays moisture in the duct. It is possible to use this humidifying unit even in a unit which carries out blowing by the pump in the embodiment in FIG. 3.

In the second embodiment and the third embodiment shown in FIGS. 3 and 4, at the time of making vibrate the meniscus of the ink inside the nozzles 2*b*, the air is not only sucked or only blown by the pump, but the suction and the blowing of air may be carried out alternately at a predetermined cycle. In this manner, in a case of making vibrate the meniscus by carrying out the suction and the blowing of air alternately, it is possible to facilitate the maintenance and recovery of the jetting function of the nozzles 2*b* without consuming the ink, similarly as in the first embodiment described above.

Moreover, in each embodiment, the nozzles 2*b* (the carriage 3) may be moved with respect to the openings (apertures) 12 at the same time as carrying out the suction or blowing of air continuously from the openings (apertures) 12 at the position of carrying out the maintenance and recovery of the jetting function of the nozzles 2*b*. For example, in the third embodiment, as shown in FIG. 5, it is possible to make the meniscus vibrate by changing an air pressure of suction or blowing which acts on the nozzle 2*b*, by changing a distance in the main scanning direction between the nozzle 2*b* and the opening (aperture) 12 by moving the carriage 3. For example, as shown in diagram of each embodiment, the carriage 3 reciprocates only in a small range (micro range) with the entire surface of the nozzle surface 2*a* facing the plurality of openings (apertures) 12. Moreover, the openings (apertures) 12 are provided only in a range shorter than the length of the nozzle surface 2*a* in the main scanning direction X, and the carriage is made to pass above this small range, and the meniscus is made to vibrate by bringing close and moving away each nozzle 2*b* from the opening (aperture) 12. The platen 7*a* and the extended portion 7*b* may be separate components. It is possible to achieve a similar effect even by moving the extended portion 7*b* almost parallel to the nozzle surface 2*a*, and moving the opening (aperture) 12 with respect to the nozzle 2*b*.

In each embodiment described above, when the pump 11 carries out blowing of air, in a state in which the nozzle surface 2*a* and the opening (apertures) 12 face mutually, the recording head 2 may be driven at a timing of sucking the air near the nozzles 2*b* by the opening (apertures) 12. In this case, the recording head 2 may be driven such that the meniscus of the ink is vibrated but the ink is not jetted from the nozzles 2*b* even when the abovementioned suction force is applied, in other words, it may be a driving in which, a pressure of a degree which does not destroy the meniscus is applied. In this case, it is possible to make vibrate the meniscus effectively, and to carry out the process of maintenance and recovery of the jetting function.

Moreover, the recording head 2 may be driven to an extent such that, as small quantity as possible of the ink is jetted from the nozzles 2*b*. At this time, the ink jetted is sucked by the pump, and is stored in a hitherto known waste-ink reservoir. By suction recovery of the extremely small amount of ink jetted in this manner, it is possible to avoid stains of ink on the recording paper P.

In the embodiments described above, the recording head is capable of moving integrally with the carriage in a predetermined direction. However, the present invention is not restricted to such arrangement, and the recording head may be a line head which is not provided movably, for example. In this case, by arranging a vibration generating unit (mechanism) which has about same length as the line head, facing the line head, it is possible to make vibrate the meniscus of the liquid inside the nozzle of the line head.

Moreover, in the embodiments described above, the vibration generating unit (section) is arranged at an outer side in the direction of width of the recording medium. However, the present invention is not restricted to such arrangement, and the vibration generating unit may be arranged only at an inner side in the direction of width of the recording medium. In this case, when the recording medium is arranged at an upper side of the vibration generating unit, and the recording is carried out, the vibration generating unit is not capable of making vibrate the meniscus inside the nozzle. However, in a case such as a case of carrying out printing continuously on a plurality of recording media for example, during an interval after the previous recording medium is discharged and till the subsequent recording medium is sent under the recording head, the vibration generating unit is capable of making vibrate the meniscus of the liquid inside the nozzle. Accordingly, it is possible to prevent drying and thickening of the liquid inside the nozzle. Further, since a gap is formed between the nozzle surface and the vibration generating unit, that is, the nozzle surface does not make contact with the vibration generating unit, it is possible to avoid from the ink-adhesion on the vibration generation unit. Furthermore, the gap is maintained during the operation of the vibration generation unit such that a space between the nozzle surface and the vibration generating unit is not sealed. Therefore, the pressure of the space between the nozzle surface and the vibration generating unit does not become too high/low, and the meniscus of the liquid in the nozzles is kept.

In the image forming apparatus of the present invention, it is possible to use not only a paper but also materials such as a resin sheet and a cloth etc. as the recording medium, and moreover it is possible to use various liquids other than ink such as a colored liquid and a functional liquid.

What is claimed is:

1. An image forming apparatus which forms an image by jetting a liquid onto a medium, comprising:

a recording head having a nozzle surface in which a plurality of nozzles is formed; and a vibration generating mechanism which is arranged so that the vibration generating mechanism and the nozzle surface of the recording head face each other, where the vibration generating mechanism vibrates a meniscus of the liquid inside each of the nozzles by sucking air between the nozzle surface and the vibration generating mechanism or by blowing air to the nozzle surface.

2. The image forming apparatus according to claim 1, further comprising:

a moving mechanism which moves the recording head in a predetermined direction with respect to the medium;

wherein the vibration generating mechanism is arranged at a position away from the medium in the predetermined direction, so that the recording head can be positioned at a location where the vibration generating mechanism and the nozzle surface of the recording head face each other without the medium being located between the vibration generating mechanism and the nozzle surface.

3. The image forming apparatus according to claim 2;

wherein the vibration generating mechanism has a plurality of vibration generating sections arranged in the predetermined direction; and wherein the vibration generating sections are used selectively according to a width of the medium.

4. The image forming apparatus according to claim 3, further comprising:

a setting unit which sets the width of the recording medium;

wherein when the recording head is moved to a position away from an area corresponding to the set width, a vibration generating section among the plurality of vibration generating sections which is arranged in the vicinity of the medium is used.

5. The image forming apparatus according to claim 4, further comprising:

a detecting mechanism which detects the width of the medium;

wherein the setting unit sets the width of the medium by the detecting mechanism.

6. The image forming apparatus according to claim 2;

wherein the vibration generating mechanism sucks or blows the air continuously while moving relative to the recording head, and successively vibrates the meniscus of the liquid inside each of the nozzles facing the vibration generating mechanism.

7. The image forming apparatus according to claim 2;

wherein the vibration generating mechanism sucks the air; and wherein in a state that the vibration generating mechanism faces the nozzles, the recording head applies, to the liquid inside each of the nozzles, a pressure to an extent that the meniscus is not destroyed.

8. The image forming apparatus according to claim 6;

wherein the vibration generating mechanism sucks the air; and wherein in a state that the vibration generating mechanism faces the nozzles, the recording head applies, to the liquid inside each of the nozzles, a pressure to an extent that the meniscus is not destroyed.

9. The image forming apparatus according to claim 2;

wherein the vibration generating mechanism sucks the air;

wherein in a state that the vibration generating mechanism faces the nozzles, the recording head jets a small amount of the liquid inside the nozzles; and wherein the vibration generating mechanism sucks the small amount of the liquid jetted from the nozzles.

10. The image forming apparatus according to claim 6;

wherein the vibration generating mechanism sucks the air;

wherein in a state that the vibration generating mechanism faces the nozzles, the recording head jets a small amount of the liquid inside the nozzles; and wherein the vibration generating mechanism sucks the small amount of the liquid jetted from the nozzles.

11. The image forming apparatus according to claim 2;

wherein the vibration generating mechanism blows the air; and wherein the blown air has a humidity higher than that of atmosphere.

12. The image forming apparatus according to claim 6;

wherein the vibration generating mechanism blows the air; and wherein the blown air has a humidity higher than that of atmosphere.

13. The image forming apparatus according to claim 1:

wherein the vibration generating mechanism blows the air; and wherein the vibration generating mechanism has a humidifying mechanism which increases a humidity of the air inside the vibration generating mechanism.

14. The image forming apparatus according to claim 2;

wherein the vibration generating mechanism faces the nozzle surface of the recording head moved to the position, alternately sucks and blows the air from and to the nozzle surface, and vibrates the meniscus of the liquid inside each of the nozzles.

15. The image forming apparatus according to claim 14;

wherein in a state that the vibration generating mechanism sucks the air, the recording head applies, to the liquid inside each of the nozzles, a pressure to an extent that the meniscus is not destroyed.

16. The image forming apparatus according to claim 14;

wherein in a state that the vibration generating mechanism sucks the air, the recording head jets a small amount of the liquid inside the nozzles; and wherein the vibration generating mechanism sucks the small amount the liquid jetted from the nozzles.

17. The image forming apparatus according to claim 14;

wherein the blown air has humidity higher than that of atmosphere.

18. The image forming apparatus according to claim 2, further comprising:

a platen which supports the medium at a position facing the recording head;

wherein the vibration generating mechanism is arranged to extend from the platen in a moving direction of the recording head;

wherein an opening through which the air circulates is formed at a portion, of the vibration generating mechanism, away from the medium; and wherein the vibration generating mechanism includes a pump which circulates the air through the opening.

19. The image forming apparatus according to claim 6, further comprising:

a platen which supports the medium at a position facing the recording head;

wherein the vibration generating mechanism is arranged to extend from the platen in a moving direction of the recording head;

wherein an opening through which the air circulates is formed at a portion, of the vibration generating mechanism, away from the medium; and wherein the vibration generating mechanism includes a pump which circulates the air through the opening.

20. The image forming apparatus according to claim 14, further comprising:

a platen which supports the medium at a position facing the recording head;

wherein the vibration generating mechanism is arranged to extend from the platen in a moving direction of the recording head;

wherein an opening through which the air circulates is formed at a portion, of the vibration generating mechanism, away from the medium; and wherein the vibration generating mechanism includes a pump which circulates the air through the opening.

21. The image forming apparatus according to claim 2, further comprising:

a platen which supports the medium at a position facing the recording head;

wherein the vibration generating mechanism is arranged to extend from the platen in a moving direction of the recording head;

wherein an opening through which the air circulates is formed at a portion, of the vibration generating mechanism, away from the medium;

wherein the vibration generating mechanism includes a pump which circulates the air through the opening;

wherein an opening is formed in a surface, of the platen, on a side of the medium; and wherein the pump sucks the air from both of the opening of the vibration generating mechanism and the opening of the platen.

22. The image forming apparatus according to claim 6, further comprising;

a platen which supports the medium at a position facing the recording head;

wherein the vibration generating mechanism is arranged to extend from the platen in a moving direction of the recording head;

wherein an opening through which the air circulates is formed at a portion, of the vibration generating mechanism, away from the medium;

wherein the vibration generating mechanism includes a pump which circulates the air through the opening;

wherein an opening is formed in a surface, of the platen, on a side of the medium; and wherein the pump sucks the air from both of the opening of the vibration generating mechanism and the opening of the platen.

23. The image forming apparatus according to claim 21;

wherein the opening of the vibration generating mechanism and the opening of the platen are provided as a plurality of openings on one plane in the moving direction of the recording head; and wherein the openings are used, based on the width of the medium, selectively and appropriately as openings of the vibration generating mechanism and as openings for suction-attracting the recording medium with respect to the platen.

24. The image forming apparatus according to claim 22;

wherein the opening of the vibration generating mechanism and the opening of the platen are provided as a plurality of openings on one plane in the moving direction of the recording head; and wherein the openings are used, based on the width of the medium, selectively and appropriately as openings of the vibration generating mechanism and as openings for suction-attracting the recording medium with respect to the platen.

25. The image forming apparatus according to claim 1, further comprising:

a platen which supports the medium at a position facing the recording head;

wherein the vibration generating mechanism is formed integrally with the platen.

* * * * *